US005392478A

United States Patent [19]

Johenning

[11] Patent Number: 5,392,478

[45] Date of Patent: Feb. 28, 1995

[54] WATERBED WITH SUPPLEMENTAL SUPPORT

[75] Inventor: John B. Johenning, Beverly Hills, Calif.

[73] Assignee: Strata Flotation, Inc., Torrance, Calif.

[21] Appl. No.: 672,815

[22] Filed: Mar. 21, 1991

Related U.S. Application Data

[63] Continuation-in-part of Ser. No. 370,311, Jun. 22, 1989, abandoned.

[51] Int. Cl.[6] ..... A47C 27/00; A47C 27/08

[52] U.S. Cl. ..... 5/462; 5/450; 5/465; 5/485

[58] Field of Search ..... 5/450, 451, 462, 464, 5/465, 485, 490

[56] References Cited

U.S. PATENT DOCUMENTS

| | | | |
|---|---|---|---|
| 2,162,021 | 6/1939 | Kidwell | 5/462 |
| 2,563,124 | 8/1951 | Maher | 5/464 |
| 4,015,299 | 4/1977 | Tinnel | 5/451 |
| 4,365,371 | 12/1982 | Boussaroque | 5/462 |
| 4,382,306 | 5/1983 | Lickert | 5/462 |
| 4,491,993 | 6/1985 | Santo | 5/451 |
| 4,549,323 | 10/1985 | Brockhaus | 5/451 |
| 4,602,396 | 7/1986 | Fraige | 5/451 |
| 4,686,721 | 8/1987 | Hubert | 5/451 |
| 4,941,222 | 7/1990 | Prager | 5/465 |

FOREIGN PATENT DOCUMENTS

| | | | |
|---|---|---|---|
| 2067897 | 8/1981 | United Kingdom | 5/462 |
| 2196245 | 4/1988 | United Kingdom | 5/464 |

*Primary Examiner*—Flemming Saether
*Attorney, Agent, or Firm*—Flehr, Hohbach, Test, Albritton & Herbert

[57] ABSTRACT

Waterbed with supplemental support for providing different degrees of localized firmness or support in different areas of a mattress. The bed includes a water-filled mattress having a horizontally extending upper wall and a chamber containing a body of water for buoyantly supporting a person resting on the upper wall, a pocket on the upper wall, and a pad disposed in the pocket and extending across a portion of the upper wall for providing additional localized support for a person resting on the upper wall so that the person is supported by a combination of the water and the pad. The pocket is of greater horizontal extent than the pad, and the pad can be moved to different positions within the pocket to support different portions of the body of a person resting on the mattress. The pad can comprise either an air-filled cushion or a foam cushion, and the firmness or degree of support provided by the pad can be adjusted by adjusting the amount of air in an air-filled cushion or by changing the foam cushion.

10 Claims, 5 Drawing Sheets

WATERBED WITH SUPPLEMENTAL SUPPORT

This is a continuation-in-part of Ser. No. 07/370,311, filed Jun. 22, 1989, now abandoned.

This invention pertains generally to waterbeds and, more particularly, to a waterbed having means for providing supplemental lumbar support to a person resting thereon.

Some people may prefer, or even require, a greater degree of support or firmness in a mattress for certain parts of their bodies than others. A person sleeping on a waterbed might, for example, desire a firmer degree of support for his lower back than that normally provided by a waterbed, or one of two people sleeping on a bed might desire a firmer support than the other.

The firmness of the support provided by a water mattress can be adjusted to some extent by filling the mattress with a greater or a lesser amount of water, but it is generally not possible to provide different degrees of support in different areas of the mattress by this technique unless the mattress has different chambers which can be pressurized differently.

Another way to provide greater support in one area of a waterbed is to place a material such as foam inside the water mattress where the additional support is desired. Once the mattress has been manufactured and filled with water, it can be difficult to adjust the position of the supporting material and to retain it in a desired position.

It is in general an object of the invention to provide a new and improved waterbed and support which provide a greater degree of support or firmness in one area than another.

Another object of the invention is to provide a waterbed of the above character in which the degree of support or firmness can be adjusted.

Another object of the invention is to provide a waterbed of the above character in which the area in which greater support or firmness is provided can be adjusted.

These and other objects are achieved in accordance with the invention by providing a water-filled mattress having a horizontally extending upper wall and a chamber containing a body of water for buoyantly supporting a person resting on the upper wall, a pocket on the upper wall, and a pad disposed in the pocket and extending across a portion of the upper wall for providing additional localized support for a person resting on the upper wall so that the person is supported by a combination of the water and the pad. The pocket is of greater horizontal extent than the pad, and the pad can be moved to different positions within the pocket to support different portions of the body of a person resting on the mattress. The pad can comprise either an air-filled cushion or a foam cushion, and the firmness or degree of support provided by the pad can be adjusted by adjusting the amount of air in an air-filled cushion or by changing the foam cushion.

Figure 1:
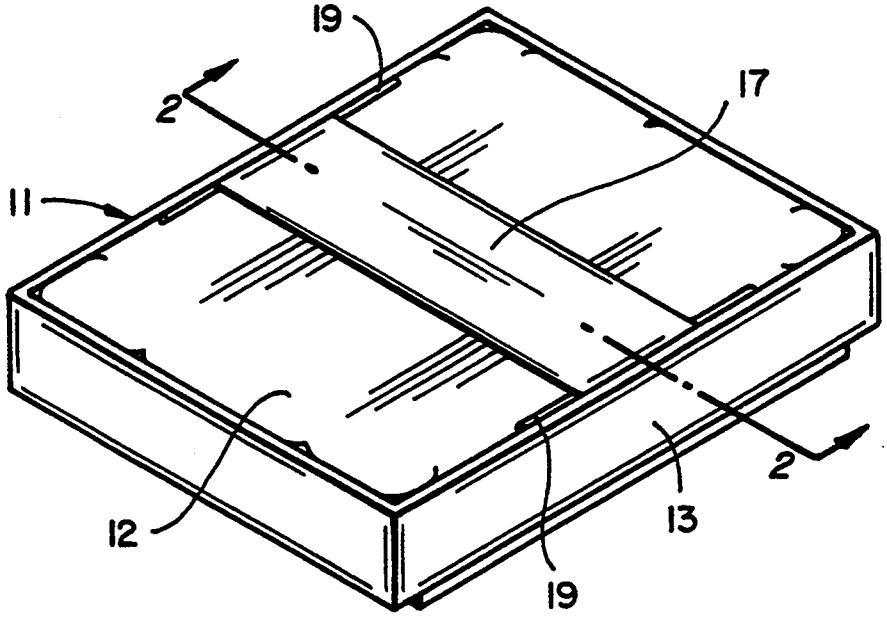
FIG. 1 is an isometric view of one embodiment of a waterbed incorporating the invention.
Figure 2:
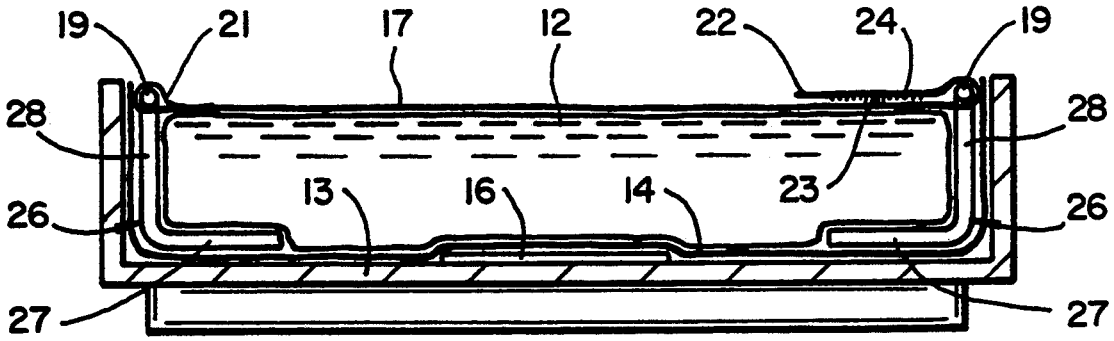
FIG. 2 is a cross-sectional view taken along line 2—2 in FIG. 1.

In the embodiment of FIG. 1, the invention is illustrated in connection with a waterbed 11 having a mattress 12 and a rigid circumscribing frame 13 which provides lateral support for the body of water in the mattress. The mattress and frame can be of any suitable design, and the mattress can have internal baffles (not shown) or other means to reduce wave motion. The bed is illustrated as having a safety liner 14 and a heater 16 of known design, as shown in FIG. 2.

A flexible supporting panel 17 extends laterally across the upper surface of the mattress in position to underlie a person resting on the mattress. In this particular embodiment, the panel is on the order of 24 inches wide, and it is positioned midway down the length of the bed where it will be beneath the lower back of a person lying on the mattress. The panel can, however, be of any desired width, and it can be positioned anywhere on the mattress that additional support is desired. It can extend across the bed in either a lengthwise direction or a crosswise direction. When the panel extends in the lengthwise direction, two people can have different degrees of firmness or support with a given mattress.

In the embodiment of FIG. 1, the panel comprises a web of a material such as nylon which does not stretch appreciably. Other suitable materials include polyesters, cotton, canvas and reinforced vinyl. If desired, the panel can have more than one layer, e.g. a layer of foam cushioning laminated to a layer of nylon or a layer of foam cushioning between two layers of nylon, and it can have any other structure desired, such as quilting. The most important characteristics of the panel are that it be flexible and that it be comfortable to lie on.

Means is provided for securing the end portions of the panel in fixed positions near the upper surface of the mattress so that the panel is suspended across the mattress and provides a sling-like support to a person lying thereon. This support supplements the support provided by the mattress gives the mattress a firmer feel in the area of the panel.

In the embodiment of FIG. 1, the end portions of the panel are connected to a pair of horizontally extending rods 19 which are mounted in fixed positions toward opposite sides of the mattress. As illustrated in FIG. 2, on one side of the bed, the end portion 21 of the panel is looped around the rod and affixed to itself by suitable means such as stitching (not shown). The other end portion 22 passes under the rod, then around the rod and back over itself, with the overlying portions of the panel being secured together by suitable means such as a Velcro fastener. This fastener has strips 23, 24 of hook and pile members which are affixed to the end portion of the panel in position for engagement with each other when the end portion is trained about the rod and folded back over itself.

The firmness of the support provided by panel 17 is dependent upon the tension in the panel, and the tension is dependent upon the relative extents to which a person resting on the panel is supported by the panel and by the mattress. This, in turn, is dependent upon the length of the panel between the supports. By adjusting the length of the panel, it is thus possible to control the tension produced in the panel and the firmness of the support provided by the panel. In the embodiment of FIG. 1, the Velcro strips 22, 23 have sufficient lateral extent to permit the panel to be adjusted to any desired length and firmness. The adjustment is made by pulling up on the overlapping end portion, or flap, to disengage the Velcro fastener, drawing the panel more tightly or loosely about the rod, and pressing the flap back against the panel to reengage the fastener to secure the panel in the new position. The adjustment is particularly easy to make since the flap is on the upper side of the panel where it is readily accessible.

Instead of the overlapping flap with Velcro fasteners, the panel can be attached to the rods by any other suitable means. For example, the flap can be secured to the remainder of the panel by hooks, snaps or interlocking ribs or flanges which permit the length of the panel to be adjusted, or the panel can be attached directly to the rods by Velcro fasteners, hooks snaps, or other suitable means. The Velcro fasteners are particularly suitable since the permit a continuous adjustment of the length of the panel, whereas the other types of fasteners mentioned permit the adjustment to be made only in discrete steps.

Somewhat surprisingly, the support provided by the panel is rather subtle, but quite effective, and a person lying on the bed may not even feel the panel or be aware that it is there. The panel does not detract from the floating sensation which one normally experiences when lying on a waterbed, although it does provide a firmer degree of localized support. The effectiveness of the panel can be demonstrated by releasing the panel while a person is lying on the bed and letting the portion of his body which was supported by the panel sink to its normal depth in the waterbed. People who have tested the invention in this manner have been quite surprised to find that they sink when the panel is released.

In the embodiment of FIG. 1, the length of the rods is greater than the width of the panel, and the panel can be moved to different positions along the length of the rods. This permits adjustment of the panel to provide additional support in different areas for persons of different heights. Alternatively, the panel can be repositioned by moving the rods to different positions.

As illustrated in FIG. 2, each of the rods 19 is part of a stand 26 which is held in position by the water in the mattress. Each stand has a pair of horizontally legs or feet 27 which rest on the bottom wall of the frame and extend beneath the mattress and a pair of uprights 28 which extend between the legs and the rod. Each stand is a rigid structure which can be fabricated of any suitable material. It can, for example, be fabricated of a length of plastic or metal tubing which is bent to form the legs, the uprights and the rod. If desired, the horizontally extending legs can be replaced with a plate which could provide the same degree of support as the legs without extending as far under the mattress in view of the greater surface area of the plate.

Stand 26 and panel 17 are readily installed in an existing bed by lifting the side portions of the mattress where the stands go and swinging the stands into position around the sides of the mattress. The free end of the panel is then slipped under its rod, wrapped back upon itself and secured in the desired position. The stands are placed inside the protective liner 16, and the bedding (not shown) is placed over the panel and between the stands and the liner.

The end portions of the panel can be held in position by any suitable means. For example, rods 19 can be attached to the side rails of frame 12 rather than being mounted on separate stands, with panel 17 being installed and adjusted just as it is with the stands.

Figure 3:
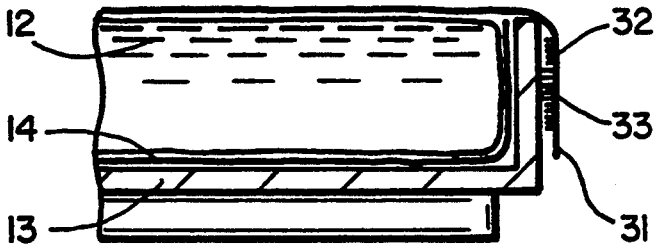
FIG. 3 is a fragmentary sectional view of another embodiment of a waterbed incorporating the invention.

FIG. 3 illustrates an embodiment in which the end portions of a panel 31 similar to panel 17 are attached directly to the side rails of the peripheral frame 12. In this particular embodiment, the panel is attached by Velcro strips 32, 33 on the under side of the panel and on the outer sides of the rails. As in the embodiment of FIG. 1, the Velcro strips permit the length of the panel and hence the degree of firmness provided by the panel to be adjusted. If desired, however, the panel can be attached to the frame by other suitable means such as hooks, snaps, or interlocking flanges.

In addition to providing increased localized support or firmness for a person lying on the mattress, the panel is also effective in preventing "bottoming out" when people sit on the edge of the bed, thus making it more comfortable to sit on the bed as well as making it easier to stand up and get off the bed.

Thus far, the invention has been illustrated in connection with a waterbed having a rigid peripheral frame. However, it is also applicable to soft-sided waterbeds which, instead of a rigid peripheral frame, have a peripheral cushion of foam or other cushioning material which is generally more comfortable to sit upon than a rigid frame.

Figure 4:
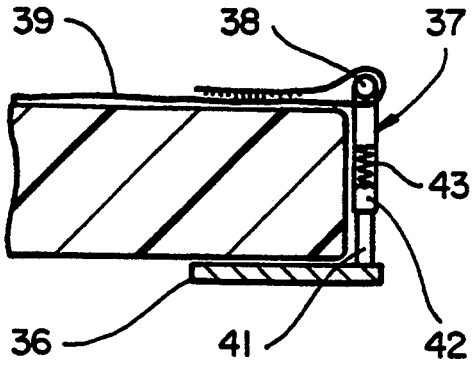
FIG. 4 is a fragmentary sectional view, partly broken away of another embodiment of bed incorporating the invention.

FIG. 4 illustrates a support stand which is particularly suitable for use in a soft-sided bed. This stand is generally similar to stand 26, and it has a plate 36 which extends under the mattress, uprights 37, and a horizontally extending rod 38 about which the end portion of a panel 39 similar to panel 17 is trained. The uprights have telescoping sections 41, 42 and a spring 43 which urges them toward an extended position in which rod 38 is generally level with the upper surface of the mattress. The rods are thus able to move vertically when a person sits or lies on them, but are constrained against movement toward each other in a horizontal direction.

Figure 5:
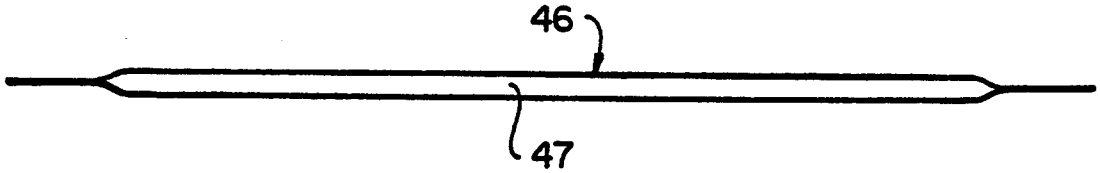
FIG. 5 is a horizontal sectional view of an embodiment of a support panel for use in a bed such as the embodiment of FIG. 1.

In the embodiment of FIG. 5, a panel 46 similar to panel 17 is provided with a chamber 47 which can be filled with air or another suitable medium to increase the rigidity of the panel and, hence, the firmness of the support provided by the panel. If desired, a plurality of such chambers can be provided to permit the panel to have different degrees of firmness in different areas of the panel.

Figure 6:
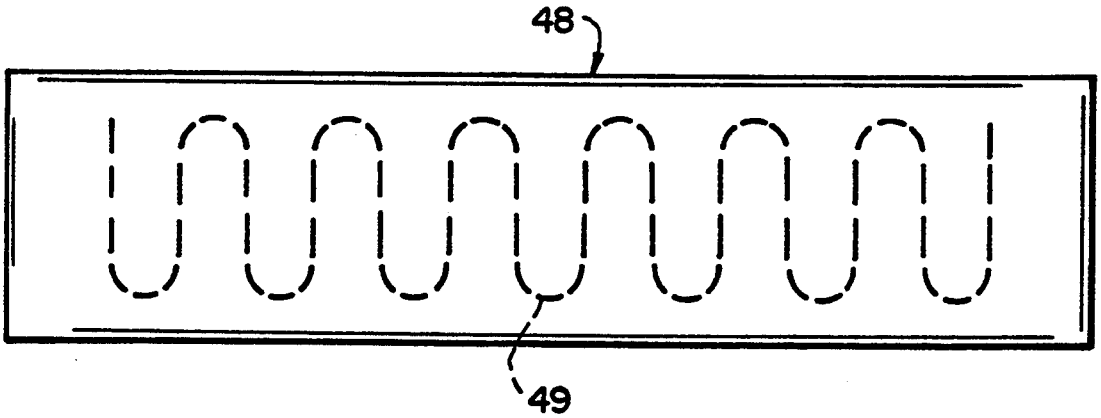
FIG. 6 is a plan view of another embodiment of a support panel for use in a bed such as the embodiment of FIG. 1.

In the embodiment of FIG. 6, a panel 48 similar to panel 17 is provided with a heater 49 to provide localized heating for the portion of a person which rests upon the panel. The heater can be any suitable type, e.g. an electrical heater of the type commonly used in heating pads, and it should be flexible so that it will not detract from the flexibility and imperceptibility of the panel.

Figure 7:
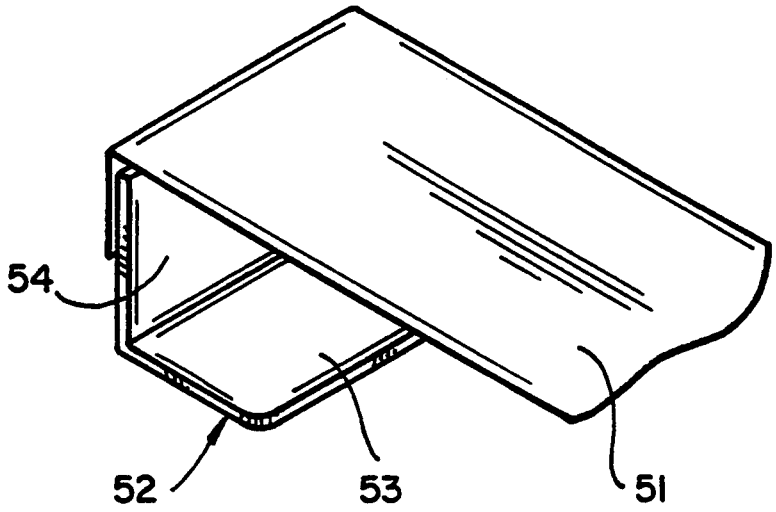
FIG. 7 is an isometric view of another embodiment of a support incorporating the invention.
Figure 8:
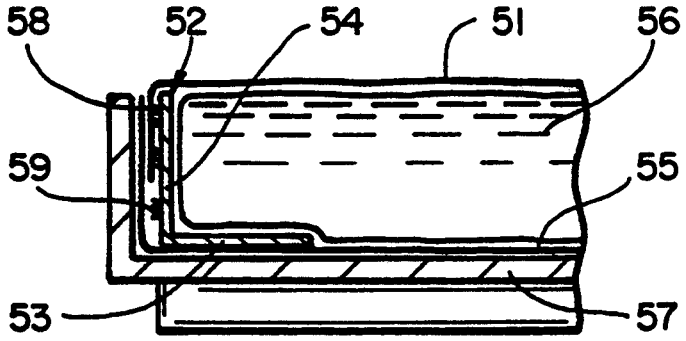
FIG. 8 is a fragmentary horizontal sectional view showing the embodiment of FIG. 7 in a bed.

FIGS. 7 and 8 illustrate an embodiment in which a panel 51 is suspended between a pair of rigid stands 52 each of which has a base plate 53 and an upright side plate 54. The stands are positioned inside the liner 55 on opposites sides of a water mattress 56 between the mattress and a peripheral frame 57.

The end portions of panel 51 are attached to upright plates 54 by Velcro strips 58, 59 on the under side of the panel and on the outer sides of the plates. Either a wide strip or a series of narrower strips can be employed to tension in the panel and hence the degree of firmness provided by the panel to be adjusted. If desired, the panel can be attached to the stand by other suitable means such as hooks, snaps, or interlocking flanges.

Figure 9:
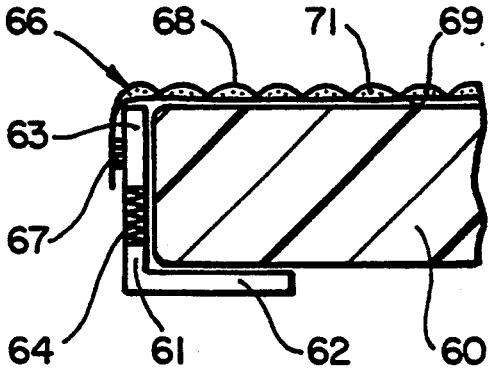
FIG. 9 is a fragmentary horizontal sectional view of another embodiment of a bed having a support incorporating the invention.

FIG. 9 illustrates the use of a stand generally similar to stand 52 with the mattress 60 of a soft sided bed, e.g. a waterbed with a peripheral foam cushion. In this embodiment, however, the upright side plates of the stands each have a lower section 61 which is rigidly affixed to the base plate 62 and an upper section 63 which mounted on the lower section for movement in a vertical direction. Springs 64 urge the upper section toward an extended position in which the upper edge of that section is generally level with the upper surface of the mattress. The upper sections are thus free to move vertically but are constrained against movement toward each other in a horizontal direction.

The end portions of a flexible support panel 66 are attached to the upper sections 63 of the side plates by suitable means such as Velcro fasteners 67. As in the other embodiments, the Velcro fasteners permit adjustment of the tension in the panel and, hence, the firmness of the support provided by the panel.

Panel 66 has two fabric layers 68, 69 with a cushioning material 71 such as foam or polyester fibers between the two layers. The upper layer 68 of the panel is quilted.

Figure 10:
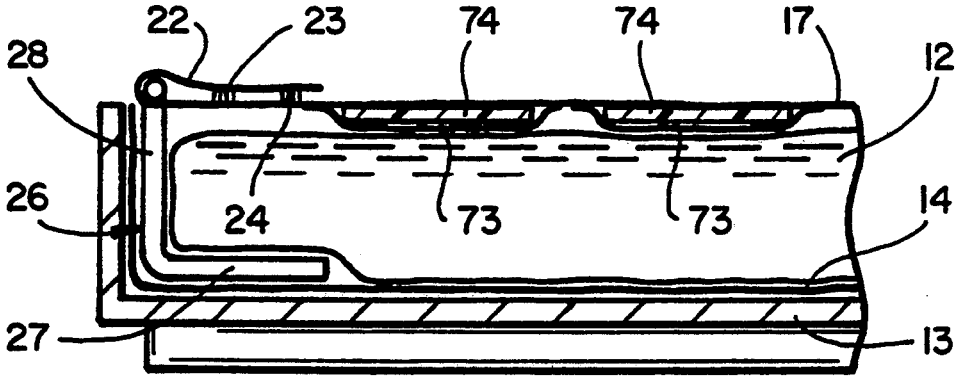
FIG. 10 is a fragmentary horizontal sectional view of another embodiment of a bed having a support incorporating the/invention.

The embodiment of FIG. 10 is similar to the embodiment of FIG. 1, and like reference numerals designate corresponding elements in the two embodiments. In the embodiment of FIG. 10, however, the panel 17 has a plurality of pockets 73 for holding pads 74 of cushioning material, e.g. foam or polyester fibers. These pads tend to stiffen the panel and thus increase the firmness of the support which it provides. If desired, the pads can be made removable so that a person using the bed can adjust the stiffness and/or thickness of the panel. Alternatively, they can be made a non-removable part of the panel.

If desired, a heat reflective material such as Mylar sheeting can be included in the support panel to reflect body heat back to a person resting on the panel. In the embodiment of FIG. 1, for example, a layer of Mylar can be laminated to the web of nylon or other material in the panel 17, or the reflective material can be applied to any cushioning material included in the panel. Similarly, in the embodiment of FIG. 10, a heat reflective material can be applied to panel 17 or to any or all of the pads 74 of cushioning material.

Figure 11:
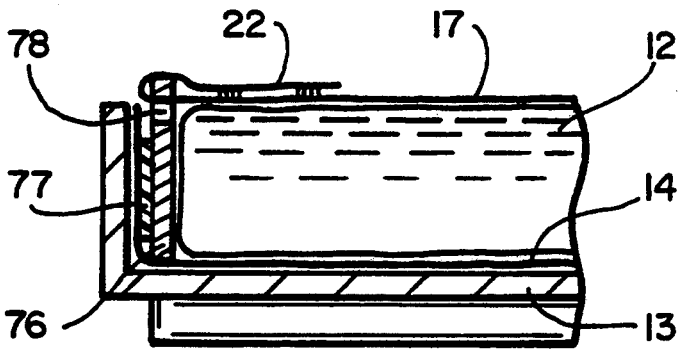
FIG. 11 is a fragmentary horizontal sectional view of another embodiment of a bed having a support incorporating the invention.

In the embodiment of FIG. 11, the end portions of support panel 17 are attached to generally rectangular plates 76 which are positioned between mattress 12 and liner 14 and are pressed against side rail of frame 13 by the pressure of the water in the mattress. The force exerted by the water pressure is substantially greater than the force exerted by the panel, and the plates remain substantially vertical without appreciable deflection due to the pull of the panel. At the same time, however, the plates can be tilted in an inward direction while the bed is being made and bedding is being tucked between the plates and the liner. A pad 77 of rubber or another material having a high coefficient of friction is mounted on the outer face of each of the plates for engagement with the liner to prevent vertical movement of the plates. Such pads can also be provided on the inner faces of the plates for frictional engagement with the mattress.

Figure 12:
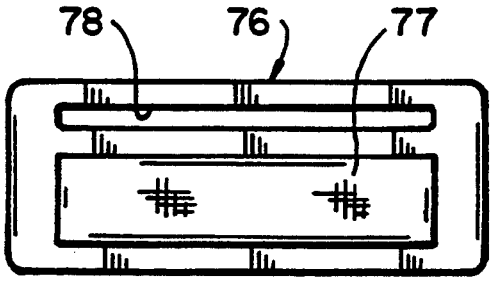
FIG. 12 is an elevational view of a support panel holding plate utilized in the embodiment of FIG. 11.

As best seen in FIG. 12, each of the plates 76 has a slotted opening 78 through which the end portion of the panel passes. The end portion is wrapped about the portion of the plate above the opening just as it is wrapped about the rod in the embodiment of FIG. 1. The plates can be fabricated of any suitable material such as wood, metal or plastic.

Figure 13:
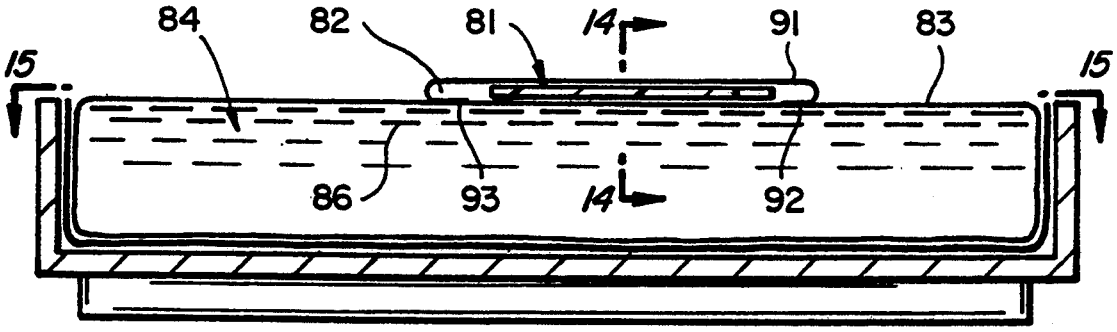
FIG. 13 is a longitudinal sectional view of another embodiment of a bed having a supplemental support in accordance with the invention.
Figure 14:
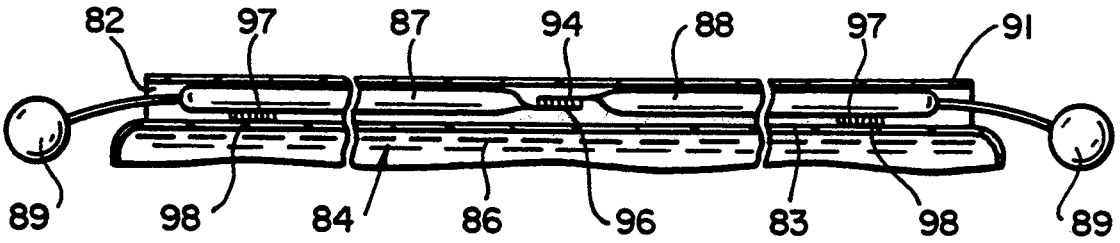
FIG. 14 is an enlarged fragmentary cross-sectional view taken along line 14—14 in FIG. 13.
Figure 15:
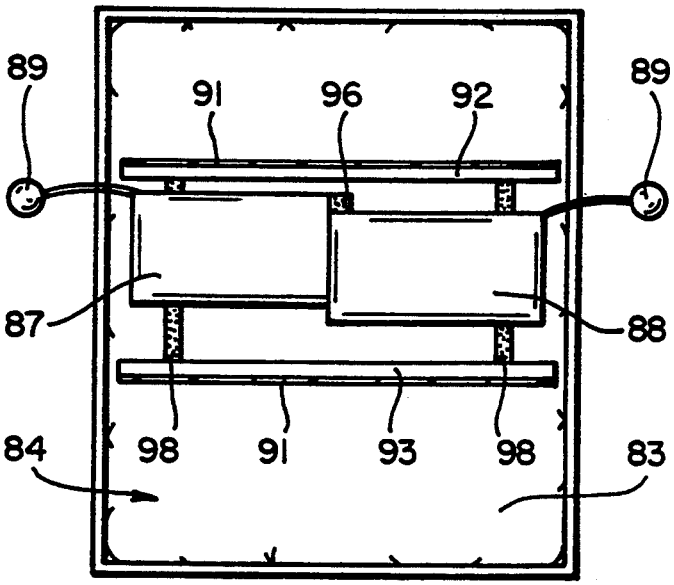
FIG. 15 is a horizontal sectional view taken along line 15—15 in FIG. 14.

In the embodiment illustrated in FIGS. 13–15, a pad 81 is disposed in a pocket 82 on the upper wall 83 of a waterbed mattress 84 to provide additional lumbar support for a person resting on the mattress so that the person is supported by a combination of the water 86 within the mattress and the pad.

In this particular embodiment, pad 81 comprises a pair of cushions 87, 88 which are disposed side-by-side within the pocket for providing individually adjustable support for each of two people on the mattress. Each of the cushions is generally rectangular and is oriented with its longer dimension extending in a lateral or widthwise direction across the bed. In one presently preferred embodiment, the width of each cushion, i.e. the dimension which extends lengthwise of the bed, is on the order of 20 inches, and the length of each cushion is somewhat less than one-half the width of the bed. Thus, for king and queen size beds, for example, the cushions have lengths on the order of 35 and 29 inches, respectively.

Cushions 87, 88 can be either air-filled cushions, foam cushions or cushions of any other suitable type for providing localized support on a waterbed mattress. In the embodiment illustrated, the cushions are filled with air and are provided with pumps 89 for adjusting the amount of air in the cushions and, thus, the firmness of the cushions and the degree of support provided thereby. If desired, the cushions can be self-inflating cushions of the type described in U.S. Pat. Nos. 4,149,919 and 4,261,776.

The foam cushions can be fabricated of any suitable cellular foam material such as polyvinyl acetate foam, ethylvinyl acetate foam, polyurethane foam, polyethylene foam and polypropylene foam, and the firmness or degree of support provided by the cushions can be changed by using foams of different density and/or by using different amounts of foam. In one presently preferred, the foam cushions are in the form of foam sheets, and the firmness of the support can be increased or decreased by using a greater or lesser number of sheets.

The pocket 82 is formed by a sheet 91 of vinyl or other suitable flexible material which is attached to the top wall of the mattress by suitable means such as heat sealing along spaced parallel lines 92, 93 which extend laterally or widthwise of the bed. The pocket extends substantially the entire width of the mattress and is open along at least one side to permit insertion and removal of the cushions. The length of the pocket, as determined by the distance between lines 92, 93, is greater than the shorter dimension of the cushions so that the cushions can be placed within the pocket in different positions lengthwise of the mattress to accommodate persons of different size and to support different portions of the body. With 20 inch cushions, the pocket can, for example, have a length of 32 inches, which would permit the cushions to be adjusted over a range of 12 inches. The end portions of the sheet are turned under to hide the seams where the sheet is attached to the upper wall, as best seen in FIG. 13. This provides a more pleasing appearance than exposed seams would have, and it also permits the cushions to move all the way to the ends of the pocket without interference from the sheet.

Alternatively, instead of attaching a sheet to the top wall by heat sealing, pocket 82 can be formed by a vinyl tube having a length greater than the width of the mattress, with the end portions of the tube being tucked between the mattress and the frame to hold the tube and the cushions in place on the bed.

Means is provided for joining the cushions together along the confronting side edges thereof to hold the two cushions in different positions relative to each other along the length of the bed. The connection between the cushions can be made by any suitable means, and in one presently preferred, it is made by strips 94, 96 of mating hook and loop material (e.g., Velcro fasteners) which extend along the confronting side edges of the cushions.

Means is also provided for holding the cushions in a desired position along the length of the mattress. In the embodiment illustrated, this means comprises strips 97, 98 of mating hook and loop material (e.g. Velcro fasteners) cemented or otherwise affixed to the under sides of the cushions and the upper side of the mattress wall. These strips extend lengthwise of the mattress.

In use, the two cushions are joined together in the desired relative positions, slipped into the pocket from the side, and positioned as desired along the length of the mattress. When the cushions are in the desired positions, the Velcro fasteners on the under sides of the cushions and the upper side of the mattress are pressed together to hold the cushions in those positions. The firmness of the cushions, and hence the fitness or degree of support provided thereby, can be adjusted by increasing or decreasing the amount of air in the cushions, by using a foam of greater or lesser density, or by using a greater or lesser number of foam sheets, depending upon the type of cushions employed.

The invention has a number of important features and advantages. It permits people to have a greater degree of support or firmness in a waterbed for certain parts of their bodies than others. The additional support or firmness provided is so subtle that in many instances it is almost imperceptible to a person receiving it. The location and firmness of the additional support are readily adjusted.

It is apparent from the foregoing that a new and improved waterbed with supplemental support has been provided. While only certain presently preferred embodiments have been described in detail, as will be apparent to those familiar with the art, certain changes and modifications can be made without departing from the scope of the invention as defined by the following claims.

I claim:

1. In a waterbed: a water-filled mattress having a horizontally extending upper wall and a chamber containing a body of water for buoyantly supporting persons resting on the upper wall, means forming a pocket on the upper wall, a pair of cushions positioned side-by-side widthwise of the bed within the pocket for providing additional localized support for persons resting on the upper wall so that the persons are supported by a combination of the water and the cushions, and means releasably connecting the cushions together and permitting adjustment of the relative positions of the cushions lengthwise of the bed.

2. The waterbed of claim 1 wherein the means releasably connecting the cushions together comprises mating hook and loop fasteners extending along confronting sides of the cushions.

3. In a waterbed: a water-filled mattress having a horizontally extending upper wall and a chamber containing a body of water for buoyantly supporting persons resting on the upper wall, a sheet of flexible material attached to the upper wall along two spaced apart lines extending widthwise across the mattress to form a pocket which is open on at least one side, a pair of cushions removably disposed in the pocket and positioned side-by-side widthwise of the bed for providing additional localized support for persons resting on the upper wall so that the persons are supported by a combination of the water and the cushions, and means releasably connecting the cushions together and permitting adjustment of the relative positions of the cushions lengthwise of the bed.

4. The waterbed of claim 3 wherein the means releasably connecting the cushions together comprises mating hook and loop fasteners extending along confronting sides of the cushions.

5. In a waterbed: a water-filled mattress having a horizontally extending upper wall and a chamber containing a body of water for buoyantly supporting persons resting on the upper wall, a sheet of flexible material attached to the upper wall along two spaced apart lines extending widthwise across the mattress to for a pocket which is open on at least one side, a pair of cushions positioned side-by-side within the pocket for providing additional localized support for persons resting on the upper wall so that the persons are supported by a combination of the water and the cushions, and means releasably connecting the cushions together and permitting adjustment of the relative positions of the cushions lengthwise of the bed within the pocket to support different portions of the bodies of the persons resting thereon.

6. The waterbed of claim 5 wherein each of the cushions comprises an air-filled cushion, and means for adjusting the amount of air therein to control the fitness of the cushion.

7. The waterbed of claim 5 wherein the cushions are fabricated of a cellular foam material selected from the group consisting of polyvinyl acetate foam, ethylvinyl acetate foam, polyurethane foam, polyethylene foam and polypropylene foam.

8. The waterbed of claim 5 wherein the means releasably connecting the cushions together comprises mating hook and loop fasteners extending along confronting sides of the cushions.

9. The waterbed of claim 5 including hook and loop fasteners carried by the cushions and the upper wall of the mattress for securing the cushions in different positions lengthwise of the bed.

10. In a waterbed: a water-filled mattress having a horizontally extending upper wall and a chamber containing a body of water for buoyantly supporting persons resting on the upper wall, means forming a pocket on the upper wall, and a pair of individually adjustable cushions positioned side-by-side within the pocket for providing additional localized support for persons resting on the upper wall so that the persons are supported by a combination of the water and the cushions.

* * * * *